US005515042A

United States Patent [19]

Nelson

[11] Patent Number: 5,515,042

[45] Date of Patent: May 7, 1996

[54] TRAFFIC ENFORCEMENT DEVICE

[76] Inventor: Lorry Nelson, 11200 W. 121st Ter., Overland Park, Kans. 66213

[21] Appl. No.: 375,900

[22] Filed: Jan. 20, 1995

Related U.S. Application Data

[63] Continuation of Ser. No. 110,721, Aug. 23, 1993, abandoned.

[51] Int. Cl.[6] ..... G08G 1/01

[52] U.S. Cl. ..... 340/937; 340/936; 364/438; 348/118; 348/149

[58] Field of Search ..... 340/937, 936, 340/934, 436, 449, 935, 995, 990; 364/437, 436, 438; 348/113, 118, 148, 149

[56] References Cited

U.S. PATENT DOCUMENTS

| | | | |
|---|---|---|---|
| 3,060,434 | 10/1962 | Biedermann et al. | 340/937 |
| 3,165,373 | 1/1965 | Scott | 340/937 |
| 3,222,682 | 12/1965 | Scott | 340/937 |
| 3,663,937 | 5/1972 | Bolner | 340/937 |
| 3,680,043 | 7/1972 | Angeloni | 340/937 |
| 3,685,012 | 8/1972 | Case et al. . | |
| 3,930,735 | 1/1976 | Kerr | 356/389 |
| 4,173,010 | 10/1979 | Hoffman | 340/937 |
| 4,734,725 | 3/1988 | Bierman | 354/266 |
| 4,777,527 | 10/1988 | Camps et al. | 348/162 |
| 4,839,648 | 6/1989 | Beucher et al. | 340/933 |
| 4,847,772 | 7/1989 | Micalopoulos et al. | 364/436 |
| 4,866,438 | 9/1989 | Knisch | 340/936 |
| 4,884,072 | 11/1989 | Horsch | 340/937 |
| 4,887,080 | 12/1989 | Gross | 340/937 |
| 4,902,889 | 2/1990 | Sodi | 250/222.1 |
| 4,903,212 | 2/1990 | Yokouchi | 364/449 |
| 4,988,994 | 1/1991 | Loeven | 340/936 |
| 5,041,828 | 8/1991 | Loeven | 340/937 |
| 5,115,109 | 5/1992 | Fisher | 200/86 A |
| 5,161,107 | 11/1992 | Mayeaux et al. | 364/436 |
| 5,198,831 | 3/1993 | Burrell et al. | 343/895 |
| 5,231,393 | 7/1993 | Strickland | 340/936 |
| 5,267,042 | 11/1993 | Tsuchiya et al. | 358/209 |
| 5,359,404 | 10/1994 | Dunne | 356/5 |

*Primary Examiner*—Brent A. Swarthout
*Assistant Examiner*—Nina Tong
*Attorney, Agent, or Firm*—Hovey, Williams, Timmons & Collins

[57] ABSTRACT

An improved traffic monitoring and evidence gathering device (10) is provided which can be mounted in a mobile monitoring vehicle (32) in order to monitor vehicle traffic speed and, when a speeding violation is detected, to generate a vehicle-identifying image (38) having date, time, vehicle speed and location information imposed thereon. The device (10) includes a speed detector (12) operably coupled with a camera (14) and global positioning monitor (16); the monitor (16) is also connected to camera (14). When a monitored vehicle's speed exceeds a predetermined magnitude, the detector (12) generates an output serving to initiate operation of the camera (14) and satellite monitor (16), and to deliver speed information to the camera (14). The camera (14) creates a vehicle-identifying image (38), and imposes on the image (38) the speed and position information.

1 Claim, 1 Drawing Sheet

TRAFFIC ENFORCEMENT DEVICE

This application is a continuation of application Ser. No. 08/110,721, filed 08/23/93, now abandoned.

BACKGROUND OF THE INVENTION

1. Field of the Invention

The present invention is broadly concerned with an improved traffic enforcement device of the type designed to provide rapid, accurate and legally admissible evidence pertaining to the identification, speed and location of moving vehicles. More particularly, the invention pertains to a mobile unit designed to be carried in a monitoring vehicle and which includes a traffic speed detector (e.g. a radar or laser speed detector), a camera and global positioning satellite monitor; these components are operably coupled so that, when a moving vehicle being monitored exceeds a predetermined speed limit, an identifying image of the vehicle is taken via the camera, and both speed and location information from the detector and monitor is imposed upon the image.

2. Description of the Prior Art

Simple hand-held or mobile speed detectors using radar or laser technology have long been available and are the bane of drivers habitually exceeding speed limits. Generally speaking, in the use of these devices extraneous evidence is required regarding the date, time of day, and location of the speeding offense. As a consequence, the testimony of the arresting officer is generally required to ensure a conviction of the traffic offender.

A recent innovation in traffic enforcement equipment combines a stationary camera and speed detecting equipment. In such devices, the camera is placed at a fixed location and is coupled with the speed detector. When a speeder passes the fixed location, the detector operates and the camera is simultaneously activated to create an identifying image of the vehicle, typically by photographing the vehicle's license plate. In order to increase the evidentiary impact of the image, the speed information from the speed detector is imposed on the image. However, these units cannot readily be used from a mobile platform, inasmuch as they provide no evidence regarding the particular location of a speeding offense. A combination device of this type is disclosed in U.S. Pat. No. 4,988,994, which is incorporated by reference herein.

Global positioning satellite monitors as a part of complete global positioning systems (GPS) have recently become available. This equipment is highly accurate, and can effectively provide the user with location information by receiving multiple satellite signals. Civilian use global positioning systems of this character can readily ascertain locations within one hundred meters of true locations. Exemplary GPS equipment is disclosed in U.S. Pat. Nos. 4,903,212 and 5,198,831; these patents are incorporated by reference herein.

SUMMARY OF THE INVENTION

The present invention overcomes the problems outlined above, and provides improved traffic monitoring and evidence gathering devices for use in mobile traffic monitoring vehicles, in order to provide an accurate and convenient technique for monitoring traffic speeds and issuance of valid, enforceable traffic citations.

Broadly speaking, the device of the invention includes traffic speed detecting means for determining the absolute speed of a moving vehicle proximal to a monitoring vehicle. The detector is operable for generating a detection output, including speed information establishing the absolute speed of the vehicle, when such absolute speed exceeds a predetermined magnitude. Exemplary speed detectors useful in the context of the invention include radar or laser detectors.

The devices hereof also include a camera operably coupled with the speed detecting means for receiving speed information therefrom, and for creating an identifying image of the moving vehicle in response thereto. Such a camera may be a conventional still photographic camera, or more usually a video camera (camcorder). In any case, the camera is oriented in the moving vehicle for uniquely identifying a vehicle being monitored, typically by creating an image of the vehicle's license plate. Where a video camera is employed, a zoom lens can be used to not only create an image of the license plate, but also the moving vehicle as a whole. Also, use of a video camera allows a microphone to be employed, so that the operator of the monitoring vehicle can record his or her comments about the monitored vehicle.

The overall device of the invention further includes a global positioning satellite monitor which is coupled with the speed detecting means and camera. The satellite monitor is operable for creating position-identifying information about the monitoring vehicle, in response to detection output from the speed detector; this position-identifying information is in turn delivered to the camera.

In order to create the optimum evidence of a speeding infraction, the camera includes means for imposing the speed information from the detecting means and the position-identifying information from the satellite monitor onto the identifying image of the monitored vehicle.

Generally, if use is made of the preferred video camera, the date and time may be readily imposed on the recorded image as a part of the video camera's normal operation. Alternately, if this function is not present, a separate timer may be coupled to the speed detector and camera for this purpose.

DETAILED DESCRIPTION OF THE PREFERRED EMBODIMENTS

Figure 1:
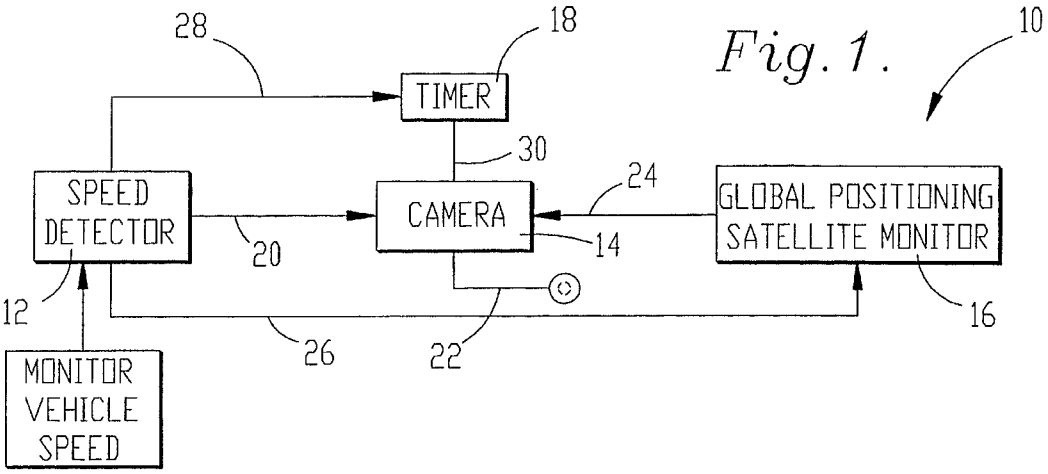
FIG. 1 is a schematic block diagram of the traffic monitoring and evidence gathering device of the invention.

Turning now to the drawings, and particularly FIG. 1, a traffic monitoring and evidence gathering device 10 is depicted. Broadly, the device 10 includes a speed detector 12, camera 14 and a global positioning satellite monitor 16. Where camera 14 is not equipped with a timer, a separate timer 18 may be provided.

In more detail, speed detector 12 is of conventional design and may be of the radar or laser variety. The detector 12 is operable for generating a detection output including speed information establishing the absolute speed of a moving vehicle, when the latter exceeds a predetermined magnitude.

To this end, the detector 12 would typically include an input with the monitoring vehicle's speed and conventional comparison circuitry for generating accurate speed information about the moving vehicle being monitored. Also, such a detector would normally have an audible or visually observable alarm which would be activated when a speed in excess of the predetermined magnitude was detected. Such an alarm would allow the user to initiate operation of the overall device 10 by pushing an operator button; alternately, such operation could be automatically initiated without an intervening alarm and operator action.

As indicated above, camera 14 may be of the still or video variety, but is preferably the latter. The camera 14 is coupled to speed detector 12 via connection 20, which allows the camera to receive absolute speed information from the detector. A microphone 22, typically a part of a video camera, may also be activated and used during the operation of the camera.

The satellite monitor 16 is also of conventional design and is operably coupled with camera 14 via connection 24. The monitor 16 is a part of a GPS, and is used to create position-identifying information about the monitoring vehicle, and for delivering this information to the camera 14.

The detector 12 and monitor 16 are also interconnected by means of connector structure 26. And if necessary, the separate timer 18 is coupled to detector 12 via connector 28, and to camera 14 via connector 30.

The device 10 is mounted in a mobile monitoring vehicle 32 (see FIG. 2), usually on the dashboard thereof. The camera 14 is oriented for recording and imaging of vehicles to be monitored, such as vehicle 34, in order to provide a unique identifying image thereof. For this purpose, the camera 14 would normally be positioned to record an image of the license plate 36 of the vehicle 34. As a useful option, the camera 14 may include a zoom lens so that the license plate image can be taken and in addition the lens can be shifted so as to record an image of the entire vehicle 34.

The speed detector 12 would also normally be dashboard-mounted and generally aligned with the camera 14 so that the two components would be directed at the same vehicle at the same time.

Figure 2:
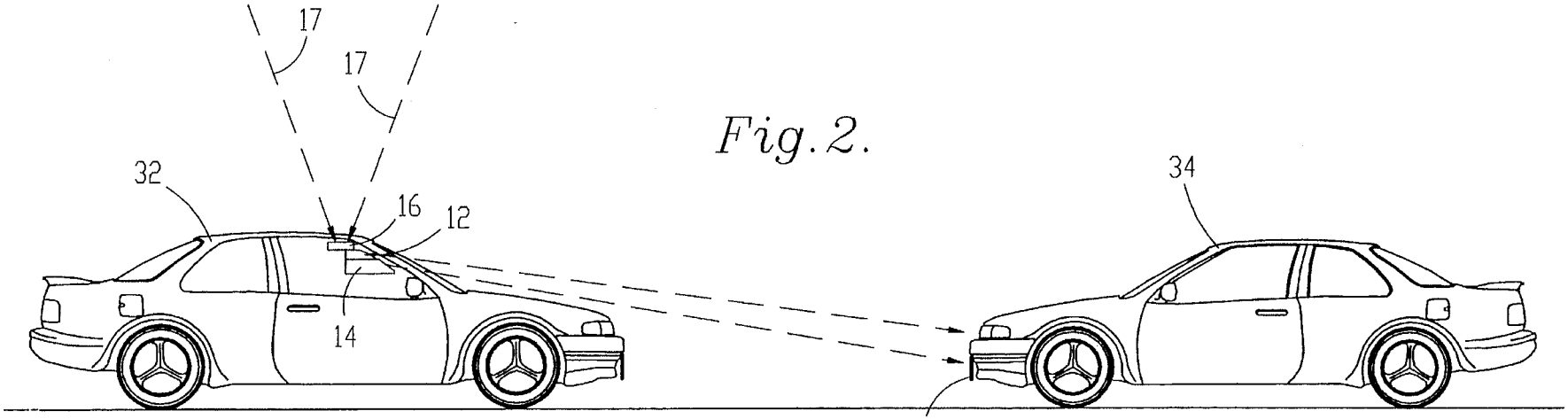
FIG. 2 is a schematic representation illustrating use of the device of the invention from a mobile monitoring vehicle.

Finally, the monitor 16 would be placed at some convenient position within the monitoring vehicle 32, but in this case there is no particular need for a dashboard mount. As illustrated in FIG. 2, the monitor 16 is operable to receive signals 17 from a plurality of orbiting satellites.

In use, the monitoring vehicle 32 would proceed among normal traffic with the detector 12 operating. This would be in a manner exactly analogous to conventional radar or laser detectors now in use, i.e., the operator vehicle 32 would position the vehicle so as to properly monitor successive vehicles 34 in the traffic stream.

When a given vehicle 34 was detected as traveling at a speed in excess of the predetermined limit of the detector 12, the latter would operate (either automatically or via an alarm and consequent user activation) to generate a detector output, including speed information establishing the absolute speed of the monitored vehicle. This detector output would in turn activate the satellite monitor 16, initiate camera operation, and deliver the absolute speed information to camera 14. The monitor 16 would, upon receipt of the relevant satellite signals, calculate the position of the monitoring vehicle 32, and this information would be sent via connection 24 to the camera 14.

Figure 3:
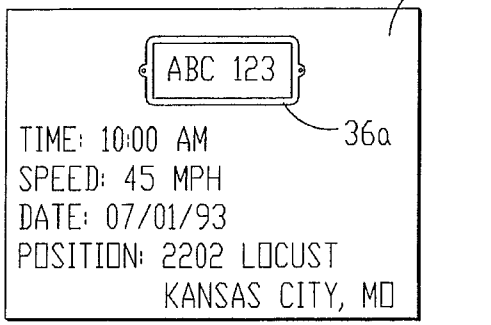
FIG. 3 is a schematic representation of a representative vehicle-identifying image having time, speed and position information imposed thereon.

The camera 14 during its operational sequence will generate a uniquely identifying image 38 (FIG. 3) of the vehicle 34, in response to detection output from detector 12. As described previously, this identifying image would typically include an image 36a of the license plate 36 of the vehicle 34. Additionally, the camera 14 is operable for imposing upon the image 38 the absolute speed and position-identifying information received from the detector 12 and monitor 16, respectively. As illustrated in FIG. 3, the excess speed of the vehicle 34 (e.g., "45 MPH") would be imposed on the image 38, as well as the position of the monitoring vehicle (e.g., latitude and longitude are converted to street address: "Main at Tenth"). Also, the date and time (e.g., "07/01/93" and "10:00AM") would also be imposed on the image 38, through a built-in camera timer if available, or through auxiliary timer 18.

Finally, if desired the operator of monitoring vehicle 32 could record his or her comments about the make, condition and operation of the monitored vehicle 34, using microphone 22. At the end of the operational sequence of device 10, the components 12, 14 and 16 are reset for the next use thereof, and the image(s) taken are preserved.

At the end of a shift for the operator of vehicle 32, the various images taken during the course of the shift are recovered and reviewed. Traffic citations can then be issued to the owners of the monitored vehicles 34 observed during the shift to be traveling in excess of relevant speed limits. Inasmuch as the speed detection, imaging and positioning components of the device 10 are highly reliable and accurate, it is anticipated that identifying images 38 will be accorded significant evidentiary weight.

Those skilled in the art will appreciate that device 10 is useful in applications other than traffic speed enforcement. For example, if monitoring vehicle 32 were stopped and in position to record an event, such as a carjacking in progress, the speed indication provided by detector 12 would register "0 MPH" because no vehicle speed would be monitored. Nevertheless, the image captured by camera 14 would have the current location of the event recorded from the data provided by satellite monitor 16. With the location information superimposed on the recorded image, very little doubt would remain as to the actual site. Thus, device 10 finds utility with the combination of camera 14 and satellite monitor 16 without the inclusion of speed detector 12. In such a configuration, device 10 would be configured so that activation of camera 14 would result in location information from satellite monitor 16 being superimposed on the recorded image.

I claim:

1. A method of monitoring traffic speed and for gathering evidence, said method comprising the steps of:

providing a monitoring vehicle equipped with a traffic speed monitoring and evidence gathering device, said device having traffic speed detecting means for determining the absolute speed of a moving vehicle proximal to said monitoring vehicle, and for generating detection output including speed information establishing the absolute speed of said moving vehicle when said absolute speed exceeds a predetermined magnitude;

a video camera operably coupled with said detecting means for receiving said speed information, and for creating an identifying moving video image of said moving vehicle in response to said speed information, said video camera including zoom lens means for taking the zoom image of the license plate of said moving vehicle, and for taking the full image of the entirety of the moving vehicle, said video camera also including microphone means for recording the audible observations of said operator relative to said moving vehicle; and a global positioning system monitor operably coupled with said speed detecting means and said speed detecting means and said camera for creating position-identifying information about said monitoring vehicle, and for delivering said position-identifying information to said camera only in response to said detection output, said camera including means for imposing said speed information, said audible observations and said position-identifying information on said zoom and full images;

placing an observer within said monitoring vehicle, and causing the monitoring vehicle to travel on a roadway where a moving vehicle is found;

operating said traffic speed detecting means to determine the absolute speed of said moving vehicle;

when said absolute speed exceeds said predetermined magnitude, operating said video camera and said zoom lens means to take a zoom image of the license plate of said moving vehicle and the full image of the moving vehicle;

causing said operator to audibly speak observations into said microphone means about said moving vehicle; and imposing on the image created by said video camera said speed information, said audible observations and said position-identifying information.

* * * * *